US009853404B2

(12) United States Patent
Zhao et al.

(10) Patent No.: US 9,853,404 B2
(45) Date of Patent: Dec. 26, 2017

(54) ELECTRICAL CONNECTOR HAVING IMPROVED TERMINAL ARRANGEMENT

(71) Applicant: FOXCONN INTERCONNECT TECHNOLOGY LIMITED, Grand Cayman (KY)

(72) Inventors: Jun Zhao, HuaiAn (CN); Tao Yao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/465,607

(22) Filed: Mar. 22, 2017

(65) Prior Publication Data

US 2017/0279233 A1 Sep. 28, 2017

(30) Foreign Application Priority Data

Mar. 22, 2016 (CN) ..... 2016 1 0163564

(51) Int. Cl.

| | |
|---|---|
| ***H01R 24/00*** | (2011.01) |
| ***H01R 24/60*** | (2011.01) |
| ***H01R 13/26*** | (2006.01) |
| *H01R 107/00* | (2006.01) |

(52) U.S. Cl.
CPC ..... *H01R 24/60* (2013.01); *H01R 13/26* (2013.01); *H01R 2107/00* (2013.01)

(58) Field of Classification Search
CPC ..... H01R 24/60; H01R 13/26; H01R 2107/00
USPC ..... 439/218, 676
See application file for complete search history.

(56) References Cited

U.S. PATENT DOCUMENTS

| | | | |
|---|---|---|---|
| 9,478,905 | B2 | 10/2016 | Golko et al. |
| 2015/0044886 | A1 | 2/2015 | Little |

FOREIGN PATENT DOCUMENTS

| | | |
|---|---|---|
| CN | 203859265 | 10/2014 |
| CN | 204205198 | 3/2015 |
| CN | 105375143 | 3/2016 |
| TW | M507094 | 8/2015 |
| TW | M518830 | 3/2016 |

*Primary Examiner* — Khiem Nguyen
(74) *Attorney, Agent, or Firm* — Wei Te Chung; Ming Chieh Chang

(57) ABSTRACT

An electrical connector includes: an insulative housing having a tongue portion, the tongue portion defining two opposite surfaces, each surface of the tongue portion including twelve terminal positions; and two rows of terminals being reversely-symmetrically arranged at the two surfaces of the tongue portion, each terminal having a contact portion exposed on the tongue portion, each row of terminals comprising two grounding terminals respectively arranged at the first and the twelfth terminal positions of the twelve terminal positions, and two power terminals respectively arranged at the fourth and the ninth terminal positions of the twelve terminal positions, the second, third, tenth and eleventh terminal positions of the twelve terminal positions being defined as vacant spaces, one or more further power terminals being arranged at the vacant spaces.

18 Claims, 16 Drawing Sheets

A

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | | | GND |
| | | | | | | | | | | | |
| GND | | | Vbus | SBU2 | D− | D+ | CC2 | Vbus | | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | | | GND |
| | | | | | | | | | | | |
| GND | | | Vbus | SBU2 | D− | D+ | CC2 | Vbus | Vbus | | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | | | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | | | GND |
| B12 | B11 | B10 | B9 | B8 | B7 | B6 | B5 | B4 | B3 | B2 | B1 |

FIG. 2

A

| A1 | A2 | A3 | A4 | A5 | A6 | A7 | A8 | A9 | A10 | A11 | A12 |
|---|---|---|---|---|---|---|---|---|---|---|---|
| GND | Vbus | GND | Vbus | CC1 | D+ | D− | SBU1 | Vbus | | | GND |
| GND | | | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | GND | | GND |
| GND | | GND | Vbus | SBU2 | D− | D+ | CC2 | Vbus | | Vbus | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | | GND | GND |
| GND | GND | | Vbus | SBU2 | D− | D+ | CC2 | Vbus | | Vbus | GND |
| B12 | B11 | B10 | B9 | B8 | B7 | B6 | B5 | B4 | B3 | B2 | B1 |

FIG. 3

A

| A1 | A2 | A3 | A4 | A5 | A6 | A7 | A8 | A9 | A10 | A11 | A12 |
|---|---|---|---|---|---|---|---|---|---|---|---|
| GND | GND | Vbus | Vbus | CC1 | D+ | D− | SBU1 | Vbus | | | GND |
| | | | | | | | | | | | |
| GND | | | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | GND | | GND |
| | | | | | | | | | | | |
| GND | | GND | Vbus | SBU2 | D− | D+ | CC2 | Vbus | Vbus | | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | | GND | GND |
| | | | | | | | | | | | |
| GND | GND | | Vbus | SBU2 | D− | D+ | CC2 | Vbus | Vbus | | GND |
| B12 | B11 | B10 | B9 | B8 | B7 | B6 | B5 | B4 | B3 | B2 | B1 |

FIG. 4

A

| A1 | A2 | A3 | A4 | A5 | A6 | A7 | A8 | A9 | A10 | A11 | A12 |
|---|---|---|---|---|---|---|---|---|---|---|---|
| GND | GND | | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | | GND | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | | GND | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | GND | | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | SBU1 | Vbus | Vbus | GND | GND |
| | | | | | | | | | | | |
| GND | GND | Vbus | Vbus | SBU2 | D− | D+ | CC2 | Vbus | | | GND |
| B12 | B11 | B10 | B9 | B8 | B7 | B6 | B5 | B4 | B3 | B2 | B1 |

FIG. 5

A

| A1 | A2 | A3 | A4 | A5 | A6 | A7 | A8 | A9 | A10 | A11 | A12 |
|---|---|---|---|---|---|---|---|---|---|---|---|
| GND | GND | | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | | GND | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | | GND | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | GND | | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | SBU1 | Vbus | GND | Vbus | GND |
| | | | | | | | | | | | |
| GND | Vbus | GND | Vbus | SBU2 | D− | D+ | CC2 | Vbus | | | GND |
| B12 | B11 | B10 | B9 | B8 | B7 | B6 | B5 | B4 | B3 | B2 | B1 |

FIG. 6

A

| A1 | A2 | A3 | A4 | A5 | A6 | A7 | A8 | A9 | A10 | A11 | A12 |
|---|---|---|---|---|---|---|---|---|---|---|---|
| GND | Vbus | GND | Vbus | CC1 | D+ | D− | SBU1 | Vbus | GND | | GND |
| | | | | | | | | | | | |
| GND | | GND | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | Vbus | GND | Vbus | CC1 | D+ | D− | SBU1 | Vbus | | GND | GND |
| | | | | | | | | | | | |
| GND | GND | | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | GND | Vbus | Vbus | CC1 | D+ | D− | SBU1 | Vbus | GND | | GND |
| | | | | | | | | | | | |
| GND | | GND | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | GND | Vbus | Vbus | CC1 | D+ | D− | SBU1 | Vbus | | GND | GND |
| | | | | | | | | | | | |
| GND | GND | | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

E

| A1 | A2 | A3 | A4 | A5 | A6 | A7 | A8 | A9 | A10 | A11 | A12 |
|---|---|---|---|---|---|---|---|---|---|---|---|
| GND | GND | GND | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | GND | GND | GND |
| B12 | B11 | B10 | B9 | B8 | B7 | B6 | B5 | B4 | B3 | B2 | B1 |

F

| A1 | A2 | A3 | A4 | A5 | A6 | A7 | A8 | A9 | A10 | A11 | A12 |
|---|---|---|---|---|---|---|---|---|---|---|---|
| GND | GND | GND | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | GND | GND | GND |
| B12 | B11 | B10 | B9 | B8 | B7 | B6 | B5 | B4 | B3 | B2 | B1 |

FIG. 7

A

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | GND | GND | GND |
| GND | GND | GND | Vbus | SBU2 | D− | D+ | CC2 | Vbus | | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | GND | GND | GND |
| GND | GND | GND | Vbus | SBU2 | D− | D+ | CC2 | Vbus | Vbus | | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | GND | | Vbus | CC1 | D+ | D− | SBU1 | Vbus | Vbus | GND | GND |
| GND | GND | Vbus | Vbus | SBU2 | D− | D+ | CC2 | Vbus | | GND | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | | GND | Vbus | CC1 | D+ | D− | SBU1 | Vbus | Vbus | GND | GND |
| GND | GND | Vbus | Vbus | SBU2 | D− | D+ | CC2 | Vbus | GND | | GND |
| B12 | B11 | B10 | B9 | B8 | B7 | B6 | B5 | B4 | B3 | B2 | B1 |

E

| A1 | A2 | A3 | A4 | A5 | A6 | A7 | A8 | A9 | A10 | A11 | A12 |
|---|---|---|---|---|---|---|---|---|---|---|---|
| GND | GND | | Vbus | CC1 | D+ | D− | SBU1 | Vbus | GND | Vbus | GND |
| GND | Vbus | GND | Vbus | SBU2 | D− | D+ | CC2 | Vbus | | GND | GND |
| B12 | B11 | B10 | B9 | B8 | B7 | B6 | B5 | B4 | B3 | B2 | B1 |

F

| A1 | A2 | A3 | A4 | A5 | A6 | A7 | A8 | A9 | A10 | A11 | A12 |
|---|---|---|---|---|---|---|---|---|---|---|---|
| GND | | GND | Vbus | CC1 | D+ | D− | SBU1 | Vbus | GND | Vbus | GND |
| GND | Vbus | GND | Vbus | SBU2 | D− | D+ | CC2 | Vbus | GND | | GND |
| B12 | B11 | B10 | B9 | B8 | B7 | B6 | B5 | B4 | B3 | B2 | B1 |

FIG. 8

A

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D− | SBU1 | Vbus | | | GND |
| | | | | | | | | | | | |
| GND | | | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | | Vbus | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | | Vbus | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | Vbus | | GND |
| B12 | B11 | B10 | B9 | B8 | B7 | B6 | B5 | B4 | B3 | B2 | B1 |

E

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | Vbus | | GND |
| B12 | B11 | B10 | B9 | B8 | B7 | B6 | B5 | B4 | B3 | B2 | B1 |

F

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | SBU1 | Vbus | Vbus | Vbus | GND |
| | | | | | | | | | | | |
| GND | Vbus | Vbus | Vbus | SBU2 | D− | D+ | CC2 | Vbus | | | GND |
| B12 | B11 | B10 | B9 | B8 | B7 | B6 | B5 | B4 | B3 | B2 | B1 |

FIG. 9

A

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | Vbus | Vbus | CC1 | D+ | D− | SBU1 | Vbus | GND | | GND |
| | | | | | | | | | | | |
| GND | | GND | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

B

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | Vbus | Vbus | CC1 | D+ | D− | SBU1 | Vbus | | GND | GND |
| | | | | | | | | | | | |
| GND | GND | | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

C

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | GND | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

D

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | GND | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

E

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | Vbus | Vbus | CC1 | D+ | D− | SBU1 | Vbus | Vbus | | GND |
| | | | | | | | | | | | |
| GND | | Vbus | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

F

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | Vbus | Vbus | CC1 | D+ | D− | SBU1 | Vbus | | Vbus | GND |
| | | | | | | | | | | | |
| GND | Vbus | | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

FIG. 10

A

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | | Vbus | CC1 | D+ | D− | SBU1 | Vbus | Vbus | GND | GND |
| | | | | | | | | | | | |
| GND | GND | Vbus | Vbus | SBU2 | D− | D+ | CC2 | Vbus | | Vbus | GND |
| B12 | B11 | B10 | B9 | B8 | B7 | B6 | B5 | B4 | B3 | B2 | B1 |

B

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | | Vbus | CC1 | D+ | D− | SBU1 | Vbus | GND | Vbus | GND |
| | | | | | | | | | | | |
| GND | Vbus | GND | Vbus | SBU2 | D− | D+ | CC2 | Vbus | | Vbus | GND |
| B12 | B11 | B10 | B9 | B8 | B7 | B6 | B5 | B4 | B3 | B2 | B1 |

C

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | | Vbus | Vbus | CC1 | D+ | D− | SBU1 | Vbus | Vbus | GND | GND |
| | | | | | | | | | | | |
| GND | GND | Vbus | Vbus | SBU2 | D− | D+ | CC2 | Vbus | Vbus | | GND |
| B12 | B11 | B10 | B9 | B8 | B7 | B6 | B5 | B4 | B3 | B2 | B1 |

D

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | | Vbus | Vbus | CC1 | D+ | D− | SBU1 | Vbus | GND | Vbus | GND |
| | | | | | | | | | | | |
| GND | Vbus | GND | Vbus | SBU2 | D− | D+ | CC2 | Vbus | Vbus | | GND |
| B12 | B11 | B10 | B9 | B8 | B7 | B6 | B5 | B4 | B3 | B2 | B1 |

E

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | | Vbus | CC1 | D+ | D− | SBU1 | Vbus | Vbus | Vbus | GND |
| | | | | | | | | | | | |
| GND | Vbus | Vbus | Vbus | SBU2 | D− | D+ | CC2 | Vbus | | GND | GND |
| B12 | B11 | B10 | B9 | B8 | B7 | B6 | B5 | B4 | B3 | B2 | B1 |

F

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | | GND | Vbus | CC1 | D+ | D− | SBU1 | Vbus | Vbus | Vbus | GND |
| | | | | | | | | | | | |
| GND | Vbus | Vbus | Vbus | SBU2 | D− | D+ | CC2 | Vbus | GND | | GND |
| B12 | B11 | B10 | B9 | B8 | B7 | B6 | B5 | B4 | B3 | B2 | B1 |

FIG. 11

A

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D− | SBU1 | Vbus | Vbus | | GND |
| GND | | Vbus | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D− | SBU1 | Vbus | | Vbus | GND |
| GND | Vbus | | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | Vbus | | Vbus | CC1 | D+ | D− | SBU1 | Vbus | Vbus | Vbus | GND |
| GND | Vbus | Vbus | Vbus | SBU2 | D− | D+ | CC2 | Vbus | | Vbus | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | Vbus | Vbus | GND |
| GND | Vbus | Vbus | Vbus | SBU2 | D− | D+ | CC2 | Vbus | Vbus | | GND |
| B12 | B11 | B10 | B9 | B8 | B7 | B6 | B5 | B4 | B3 | B2 | B1 |

FIG. 12

A

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | GND | Vbus | CC1 | D+ | D− | SBU1 | Vbus | GND | GND | GND |
| | | | | | | | | | | | |
| GND | GND | GND | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

B

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | Vbus | Vbus | CC1 | D+ | D− | SBU1 | Vbus | GND | GND | GND |
| | | | | | | | | | | | |
| GND | GND | GND | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

C

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | GND | Vbus | CC1 | D+ | D− | SBU1 | Vbus | Vbus | GND | GND |
| | | | | | | | | | | | |
| GND | GND | Vbus | Vbus | SBU2 | D− | D+ | CC2 | Vbus | GND | GND | GND |
| B12 | B11 | B10 | B9 | B8 | B7 | B6 | B5 | B4 | B3 | B2 | B1 |

D

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | GND | Vbus | CC1 | D+ | D− | SBU1 | Vbus | GND | Vbus | GND |
| | | | | | | | | | | | |
| GND | Vbus | GND | Vbus | SBU2 | D− | D+ | CC2 | Vbus | GND | GND | GND |
| B12 | B11 | B10 | B9 | B8 | B7 | B6 | B5 | B4 | B3 | B2 | B1 |

FIG. 13

A

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | Vbus | Vbus | CC1 | D+ | D− | SBU1 | Vbus | GND | GND | GND |
| GND | GND | GND | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

B

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | GND | Vbus | CC1 | D+ | D− | SBU1 | Vbus | Vbus | GND | GND |
| GND | GND | Vbus | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

C

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | Vbus | GND | Vbus | CC1 | D+ | D− | SBU1 | Vbus | GND | Vbus | GND |
| GND | Vbus | GND | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

D

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | Vbus | Vbus | CC1 | D+ | D− | SBU1 | Vbus | Vbus | GND | GND |
| GND | GND | Vbus | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

E

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | Vbus | Vbus | CC1 | D+ | D− | SBU1 | Vbus | GND | Vbus | GND |
| GND | Vbus | GND | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

F

| | | | | | | | | | | | |
|---|---|---|---|---|---|---|---|---|---|---|---|
| A1 | A2 | A3 | A4 | A5 | A6 | A7 | A8 | A9 | A10 | A11 | A12 |
| GND | GND | GND | Vbus | CC1 | D+ | D− | SBU1 | Vbus | Vbus | Vbus | GND |
| GND | Vbus | Vbus | Vbus | SBU2 | D− | D+ | CC2 | Vbus | GND | GND | GND |
| B12 | B11 | B10 | B9 | B8 | B7 | B6 | B5 | B4 | B3 | B2 | B1 |

FIG. 14

A

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D− | SBU1 | Vbus | Vbus | GND | GND |
| | | | | | | | | | | | |
| GND | GND | Vbus | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

B

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D− | SBU1 | Vbus | GND | Vbus | GND |
| | | | | | | | | | | | |
| GND | Vbus | GND | Vbus | SBU2 | D− | D+ | CC2 | Vbus | Vbus | Vbus | GND |
| B12 | B11 | B10 | B9 | B8 | B7 | B6 | B5 | B4 | B3 | B2 | B1 |

C

| A1 | A2 | A3 | A4 | A5 | A6 | A7 | A8 | A9 | A10 | A11 | A12 |
|---|---|---|---|---|---|---|---|---|---|---|---|
| GND | Vbus | GND | Vbus | CC1 | D+ | D− | SBU1 | Vbus | Vbus | Vbus | GND |
| | | | | | | | | | | | |
| GND | Vbus | Vbus | Vbus | SBU2 | D− | D+ | CC2 | Vbus | GND | Vbus | GND |
| B12 | B11 | B10 | B9 | B8 | B7 | B6 | B5 | B4 | B3 | B2 | B1 |

D

| A1 | A2 | A3 | A4 | A5 | A6 | A7 | A8 | A9 | A10 | A11 | A12 |
|---|---|---|---|---|---|---|---|---|---|---|---|
| GND | GND | Vbus | Vbus | CC1 | D+ | D− | SBU1 | Vbus | Vbus | Vbus | GND |
| | | | | | | | | | | | |
| GND | Vbus | Vbus | Vbus | SBU2 | D− | D+ | CC2 | Vbus | Vbus | GND | GND |
| B12 | B11 | B10 | B9 | B8 | B7 | B6 | B5 | B4 | B3 | B2 | B1 |

FIG. 15

A

| A1 | A2 | A3 | A4 | A5 | A6 | A7 | A8 | A9 | A10 | A11 | A12 |
|---|---|---|---|---|---|---|---|---|---|---|---|
| GND | Vbus | Vbus | Vbus | CC1 | D+ | D- | SBU1 | Vbus | Vbus | Vbus | GND |
| | | | | | | | | | | | |
| GND | Vbus | Vbus | Vbus | SBU2 | D- | D+ | CC2 | Vbus | Vbus | Vbus | GND |
| B12 | B11 | B10 | B9 | B8 | B7 | B6 | B5 | B4 | B3 | B2 | B1 |

FIG. 16

ELECTRICAL CONNECTOR HAVING IMPROVED TERMINAL ARRANGEMENT

BACKGROUND OF THE INVENTION

1. Field of the Invention

The present invention relates to an electrical connector adapted for being normally and reversely mated with a mating plug, and more particularly to an arrangement of terminals of such electrical connector.

2. Description of Related Art

China Patent No. 203859265, issued on Oct. 1, 2014, discloses a USB (Universal Serial Bus) receptacle connector including an insulative housing and two rows of terminals. Each row of terminals include two positive power terminals and two grounding terminals positioned at opposite sides of the two positive power terminals. Such connector is not intended to transfer large current. China Patent No. 204205198, issued on Mar. 11, 2015, discloses a USB plug connector for connecting to a USB receptacle connector, including an insulative housing and two rows of terminals. Each row of terminals include twelve terminals. There are only two power terminals among the twelve terminals, which again are not intended to transfer large current.

U.S. Pat. No. 9,478,905, issued on Oct. 25, 2016, discloses a dual orientation connector, including two separate sets of contacts arranged at top and bottom surfaces of housing. In some embodiments designed for specific functions, certain contacts are omitted from the connector, i.e., forming vacant spaces. For example, the connector may include four contacts, two contacts on an upper surface of a tab portion thereof and two contacts on a lower surface thereof. The four contacts provide left and right audio as well as microphone power, and are sized and spaced to match the locations, size, and spacing of predetermined contacts.

SUMMARY OF THE INVENTION

An electrical connector comprises: an insulative housing having a tongue portion, the tongue portion defining two opposite surfaces, each surface of the tongue portion including twelve terminal positions; and two rows of terminals being reversely-symmetrically arranged at the two surfaces of the tongue portion, each terminal having a contact portion exposed on the tongue portion, each row of terminals comprising two grounding terminals respectively arranged at the first and the twelfth terminal positions of the twelve terminal positions, and two power terminals respectively arranged at the fourth and the ninth terminal positions of the twelve terminal positions, the second, third, tenth and eleventh terminal positions of the twelve terminal positions being defined as vacant spaces, one or more further power terminals being arranged at the vacant spaces.

Other novel features of the invention will become more apparent from the following detailed description when taken in conjunction with the accompanying drawings.

BRIEF DESCRIPTION OF THE DRAWINGS

FIG. 2 is a perspective view showing the terminal arrangement in a first through fourth embodiments;

FIG. 3 is a perspective view showing the terminal arrangement in a fifth through seventh embodiments;

FIG. 4 is a perspective view showing the terminal arrangement in an eighth through tenth embodiments;

FIG. 5 is a perspective view showing the terminal arrangement in an eleventh through thirteenth embodiments;

FIG. 6 is a perspective view showing the terminal arrangement in a fourteenth through sixteenth embodiments;

FIG. 7 is a perspective view showing the terminal arrangement in a seventeenth through twenty-second embodiments;

FIG. 8 is a perspective view showing the terminal arrangement in a twenty-third through twenty-eighth embodiments;

FIG. 9 is a perspective view showing the terminal arrangement in a twenty-ninth through thirty-fourth embodiments;

FIG. 10 is a perspective view showing the terminal arrangement in a thirty-fifth through fortieth embodiments;

FIG. 11 is a perspective view showing the terminal arrangement in a forty-first through forty-sixth embodiments;

FIG. 12 is a perspective view showing the terminal arrangement in a forty-seventh through fiftieth embodiments;

FIG. 13 is a perspective view showing the terminal arrangement in a fifty-first through fifty-fourth embodiments;

FIG. 14 is a perspective view showing the terminal arrangement in a fifty-fifth through sixtieth embodiments;

FIG. 15 is a perspective view showing the terminal arrangement in a sixty-first through sixty-fourth embodiments; and FIG. 16 is a perspective view showing the terminal arrangement in a sixty-fifth embodiment.

DETAILED DESCRIPTION OF THE PREFERRED EMBODIMENT

Figure 1:
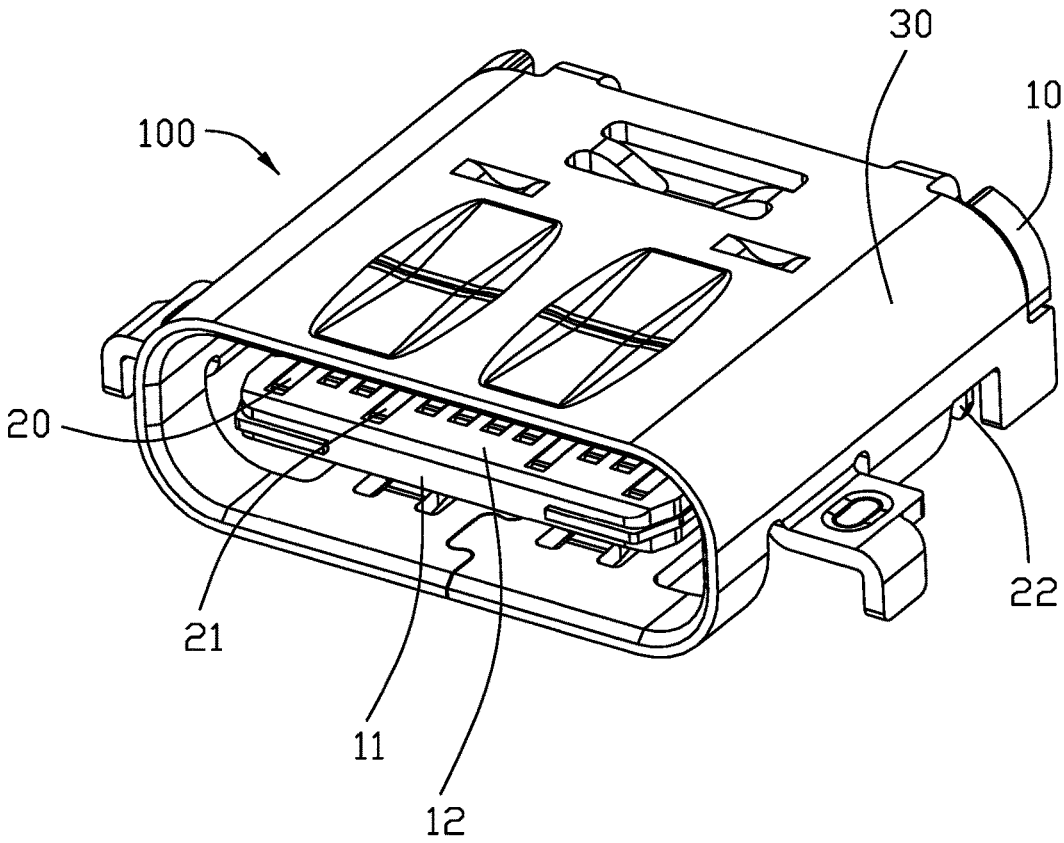
FIG. 1 is an assembled perspective view showing an electrical connector in accordance with the present invention.

Reference will now be made in detail to the preferred embodiment of the present invention. Referring to from the FIG. 1 to the FIG. 16, an electrical connector 100 shown is a receptacle connector and comprises an insulative housing 10 having a tongue portion 11, two rows of terminals 20 affixed to the insulative housing 10, and a shell 30 covering the insulative housing 10. The tongue portion 11 defines two opposite surfaces. Each surface of the tongue portion 11 includes twelve terminal positions. The two rows of terminals 20 are reversely-symmetrically, along the transverse direction, arranged at the two surfaces of the tongue portion 11. In other words, the two rows of terminals 20 are diagonally arranged with each other on the tongue portion 11. Each terminal 22 comprises a contact portion 21 exposed on the tongue portion 11 and a soldering portion 22 exposed to the tail of the insulative housing 10.

In USB Type-C standard specification, each row of the standard receptacle terminals has twelve terminals 20. In the first to the sixty-fifth embodiment of the present invention, each row of terminals 20 comprising a grounding terminal, a power terminal, a detecting terminal, a USB 2.0 positive terminal, a USB 2.0 negative terminal, a subsidiary terminal, another power terminal and another grounding terminal in first terminal position, the fourth terminal position, the fifth terminal position, the sixth terminal position, the seventh terminal position, the eighth terminal position, the ninth terminal position, and the twelfth terminal position of the twelve terminal positions, in sequence. The vacant spaces are the second terminal position, third terminal position, tenth terminal position and eleventh terminal position of the twelve terminal positions.

In FIGS. 2 to 16, 'A1-A12' designate the first terminal position to the twelfth terminal position of the twelve terminal positions of the upper surface of the tongue portion 11 from left to right. 'B1-B12' designate the first terminal position to the twelfth terminal position of the twelve terminal positions of the lower surface of the tongue portion 11 from right to left. 'GND' designates the grounding terminal; 'Vbus' designates the power terminal; 'CC1' and 'CC2' designate the detecting terminals; 'D+' designates the USB 2.0 positive terminal; 'D−' designates the USB 2.0 negative terminal; 'SBU1' and 'SBU2' designate the subsidiary terminals.

In FIG. 2, 'A', 'B', 'C', and 'D' designate perspective views showing the terminal arrangement in the first to the fourth embodiments. Only one additional power terminal is arranged at said vacant spaces in the first to the fourth embodiments.

In a first embodiment shown in FIG. 2A, each row of terminals 20 have only one additional power terminal located at the second terminal position. The third terminal position, the tenth terminal position and the eleventh terminal position are empty.

In a second embodiment shown in FIG. 2B, each row of terminals 11 have only one additional power terminal located at the third terminal position. The second terminal position, the tenth terminal position and the eleventh terminal position are empty.

In a third embodiment shown in FIG. 2C, each row of terminals 20 have only one additional power terminal located at the tenth terminal position. The second terminal position, the third terminal position and the eleventh terminal position are empty.

In a fourth embodiment shown in FIG. 2D, each row of terminals 20 have only one additional power terminal arranged at the eleventh terminal position. The second terminal position, the third terminal position and the tenth terminal position are empty.

In FIG. 3, 'A', 'B', and 'C' designate perspective views showing the terminal arrangement in the fifth to the seventh embodiments. One additional power terminal and one additional grounding terminal are arranged at said vacant spaces in the fifth to the seventh embodiments.

In a fifth embodiment shown in FIG. 3A, each row of terminals 20 have one additional power terminal located at the second terminal position and one additional grounding terminal located at the third terminal position. The tenth terminal position and the eleventh terminal position are empty.

In a sixth embodiment shown in FIG. 3B, each row of terminals 20 have one additional power terminal located at the second terminal position and one additional grounding terminal located at the tenth terminal position. The third terminal position and the eleventh terminal position are empty.

In a seventh embodiment shown in FIG. 3B, each row of terminals 20 have one additional power terminal located at the second terminal position and one additional grounding terminal located at the eleventh terminal position. The third terminal position and the tenth terminal position are empty.

In FIG. 4, 'A', 'B', and 'C' designate perspective views showing the terminal arrangement in the eighth to the tenth embodiments. One additional power terminal and one additional grounding terminal are arranged at said vacant spaces in the eighth to the tenth embodiments.

In an eighth embodiment shown in FIG. 4A, each row of terminals 20 have one additional power terminal located at the third terminal position and one additional grounding terminal located at the second terminal position. The tenth terminal position and the eleventh terminal position are empty.

In a ninth embodiment shown in FIG. 4B, each row of terminals 20 have one additional power terminal located at the third terminal position and one additional grounding terminal located at the tenth terminal position. The second terminal position and the eleventh terminal position are empty.

In a tenth embodiment shown in FIG. 4C, each row of terminals 20 have one additional power terminal located at the third terminal position and one additional grounding terminal located at the eleventh terminal position. The second terminal position and the tenth terminal position are empty.

In FIG. 5, 'A', 'B', and 'C' designate perspective views showing the terminal arrangement in the eleventh to the thirteenth embodiments. One additional power terminal and one additional grounding terminal are arranged at said vacant spaces in the eleventh to the thirteenth embodiments.

In an eleventh embodiment shown in FIG. 5A, each row of terminals 20 have one additional power terminal located at the tenth terminal position and one additional grounding terminal located at the second terminal position. The third terminal position and the eleventh terminal position are empty.

In a twelfth embodiment shown in FIG. 5B, each row of terminals 20 have one additional power terminal located at the tenth terminal position and one additional grounding terminal located at the third terminal position. The second terminal position and the eleventh terminal position are empty.

In a thirteenth embodiment shown in FIG. 5B, each row of terminals 20 have one additional power terminal located at the tenth terminal position and one additional grounding terminal located at the eleventh terminal position. The second terminal position and the third terminal position are empty.

In FIG. 6, 'A', 'B', and 'C' designate perspective views showing the terminal arrangement in the fourteenth to the sixteenth embodiments. One additional power terminal and one additional grounding terminal are arranged at said vacant spaces in the fourteenth to the sixteenth embodiments.

In a fourteenth embodiment shown in FIG. 6A, each row of terminals 20 have one additional power terminal located at the eleventh terminal position and one additional grounding terminal located at the second terminal position. The third terminal position and the tenth terminal position are empty.

In a fifteenth embodiment shown in FIG. 6B, each row of terminals 20 have one additional power terminal located at the eleventh terminal position and one additional grounding terminal located at the third terminal position. The second terminal position and the tenth terminal position are empty.

In a sixteenth embodiment shown in FIG. 6C, each row of terminals 20 have one additional power terminal located at the eleventh terminal position and one additional grounding terminal located at the tenth terminal position. The second terminal position and the third terminal position are empty.

In FIG. 7, 'A', 'B', 'C', 'D', 'E' and 'F' designate perspective views showing the terminal arrangement in the seventeenth to twenty-second embodiments. One additional power terminal and two additional grounding terminals are arranged at said vacant spaces in the seventeenth to twenty-second embodiments.

In a seventeenth embodiment shown in FIG. 7A, each row of terminals 20 have one additional power terminal located at the second terminal position and two additional grounding terminals respectively located at the third terminal position and the tenth terminal position. The eleventh terminal position is empty.

In an eighteenth embodiment shown in FIG. 7B, each row of terminals 20 have one additional power terminal located at the second terminal position and two additional grounding terminals respectively located at the third terminal position and the eleventh terminal position. The tenth terminal position is empty.

In a nineteenth embodiment shown in FIG. 7C, each row of terminals 20 have one additional power terminal located at the third terminal position and two additional grounding terminals respectively located at the second terminal position and the tenth terminal position. The eleventh terminal position is empty.

In a twentieth embodiment shown in FIG. 7D, each row of terminals 20 have one additional power terminal located at the third terminal position and two additional grounding terminals respectively located at the second terminal position and the eleventh terminal position. The tenth terminal position is empty.

In a twenty-first embodiment shown in FIG. 7E, each row of terminals 20 have one additional power terminal located at the tenth terminal position and two additional grounding terminals respectively located at the second terminal position and the third terminal position. The eleventh terminal position is empty.

In a twenty-second embodiment shown in FIG. 7F, each row of terminals 20 have one additional power terminal located at the eleventh terminal position and two additional grounding terminals respectively located at the second terminal position and the third terminal position. The tenth terminal position is empty.

In FIG. 8, 'A', 'B', 'C', 'D', 'E' and 'F' designate perspective views showing the terminal arrangement in the twenty-third to the twenty-eighth embodiments. One additional power terminal and two additional grounding terminals are arranged at said vacant spaces in the twenty-third to the twenty-eighth embodiments.

In a twenty-third embodiment shown in FIG. 8A, each row of terminals 20 have one additional power terminal located at the second terminal position and two additional grounding terminals respectively located at the tenth terminal position and the eleventh terminal position. The third terminal position is empty.

In a twenty-fourth embodiment shown in FIG. 8B, each row of terminals 20 have one additional power terminal located at the third terminal position and two additional grounding terminals respectively located at the tenth terminal position and the eleventh terminal position. The second terminal position is empty.

In a twenty-fifth embodiment shown in FIG. 8C, each row of terminals 20 have one additional power terminal located at the tenth terminal position and two additional grounding terminals respectively located at the third terminal position and the eleventh terminal position. The second terminal position is empty.

In a twenty-sixth embodiment shown in FIG. 8D, each row of terminals 20 have one additional power terminal located at the tenth terminal position and two additional grounding terminals respectively located at the third terminal position and the eleventh terminal position. The second terminal position is empty.

In a twenty-seventh embodiment shown in FIG. 8E, each row of terminals 20 have one additional power terminal located at the eleventh terminal position and two additional grounding terminals respectively located at the second terminal position and the tenth terminal position. The third terminal position is empty.

In a twenty-eighth embodiment shown in FIG. 8F, each row of terminals 20 have one additional power terminal located at the eleventh terminal position and two additional grounding terminals respectively located at the third terminal position and the tenth terminal position. The second terminal position is empty.

In FIG. 9, 'A', 'B', 'C', 'D', 'E' and 'F' designate perspective views showing the terminal arrangement in the twenty-ninth to the thirty-fourth embodiments. Two additional power terminals are arranged at said vacant spaces in the twenty-ninth to the thirty-fourth embodiments.

In a twenty-ninth embodiment shown in FIG. 9A, each row of terminals 20 have two additional power terminals respectively located at the second terminal position and the third terminal position. The tenth terminal position and the eleventh terminal position are empty.

In a thirtieth embodiment shown in FIG. 9B, each row of terminals 20 have two additional power terminals respectively located at the second terminal position and the tenth terminal position. The third terminal position and the eleventh terminal position are empty.

In a thirty-first embodiment shown in FIG. 9C, each row of terminals 20 have two additional power terminals respectively located at the second terminal position and the eleventh terminal position. The third terminal position and the tenth terminal position are empty.

In a thirty-second embodiment shown in FIG. 9D, each row of terminals 20 have two additional power terminals respectively located at the third terminal position and the tenth terminal position. The second terminal position and the eleventh terminal position are empty.

In a thirty-third embodiment shown in FIG. 9E, each row of terminals 20 have two additional power terminals respectively located at the third terminal position and the eleventh terminal position. The second terminal position and the tenth terminal position are empty.

In a thirty-fourth embodiment shown in FIG. 9F, each row of terminals 20 have two additional power terminals respectively located at the tenth terminal position and the eleventh terminal position. The second terminal position and the third terminal position are empty.

In FIG. 10, 'A', 'B', 'C', 'D', 'E' and 'F' designate perspective views showing the terminal arrangement in the thirty-fifth to the fortieth embodiments. Two additional power terminals and one additional grounding terminal are arranged at said vacant spaces in the thirty-fifth to the fortieth embodiments.

In a thirty-fifth embodiment shown in FIG. 10A, each row of terminals 20 have two additional power terminals respectively located at the second terminal position and the third terminal position, and one additional grounding terminal located at the tenth terminal position. The eleventh terminal position is empty.

In a thirty-sixth embodiment shown in FIG. 10B, each row of terminals 20 have two additional power terminals respectively located at the second terminal position and the third terminal position, and one additional grounding terminal located at the eleventh terminal position. The tenth terminal position is empty.

In a thirty-seventh embodiment shown in FIG. 10C, each row of terminals 20 have two additional power terminals respectively located at the second terminal position and the tenth terminal position, and one additional grounding terminal located at the third terminal position. The eleventh terminal position is empty.

In a thirty-eighth embodiment shown in FIG. 10D, each row of terminals 20 have two additional power terminals respectively located at the second terminal position and the eleventh terminal position, and one additional grounding terminal located at the third terminal position. The tenth terminal position is empty.

In a thirty-ninth embodiment shown in FIG. 10E, each row of terminals 20 have two additional power terminals respectively located at the third terminal position and the tenth terminal position, and one additional grounding terminal located at the second terminal position. The eleventh terminal position is empty.

In a fortieth embodiment shown in FIG. 10F, each row of terminals 20 have two additional power terminals respectively located at the third terminal position and the eleventh terminal position, and one additional grounding terminal located at the second terminal position. The tenth terminal position is empty.

In FIG. 11, 'A', 'B', 'C', 'D', 'E' and 'F' designate perspective views showing the terminal arrangement in the forty-first to the forty-sixth embodiments. Two additional power terminals and one additional grounding terminal are arranged at said vacant spaces in the forty-first to the forty-sixth embodiments.

In a forty-first embodiment shown in FIG. 11A, each row of terminals 20 have two additional power terminals respectively located at the second terminal position and the tenth terminal position, and one additional grounding terminal located at the eleventh terminal position. The third terminal position is empty.

In a forty-second embodiment shown in FIG. 11B, each row of terminals 20 have two additional power terminals respectively located at the second terminal position and the eleventh terminal position, and one additional grounding terminal located at the tenth terminal position. The third terminal position is empty.

In a forty-third embodiment shown in FIG. 11C, each row of terminals 20 have two additional power terminals respectively located at the third terminal position and the tenth terminal position, and one additional grounding terminal located at the eleventh terminal position. The second terminal position is empty.

In a forty-fourth embodiment shown in FIG. 11D, each row of terminals 20 have two additional power terminals respectively located at the third terminal position and the eleventh terminal position, and one additional grounding terminal located at the tenth terminal position. The second terminal position is empty.

In a forty-fifth embodiment shown in FIG. 11E, each row of terminals 20 have two additional power terminals respectively located at the tenth terminal position and the eleventh terminal position, and one additional grounding terminal located at the second terminal position. The third terminal position is empty.

In a forty-sixth embodiment shown in FIG. 11F, each row of terminals 20 have two additional power terminals respectively located at the tenth terminal position and the eleventh terminal position, and one additional grounding terminal located at the third terminal position. The second terminal position is empty.

In FIG. 12, 'A', 'B', 'C' and 'D' designate perspective views showing the terminal arrangement in the forty-seventh to the fiftieth embodiments. Three additional power terminals are arranged at said vacant spaces in forty-seventh to the fiftieth embodiments.

In a forty-seventh embodiment shown in FIG. 12A, each row of terminals 20 have three additional power terminals respectively located at the second terminal position, third terminal position and tenth terminal position. The eleventh terminal position is empty.

In a forty-eighth embodiment shown in FIG. 12B, each row of terminals 20 have three additional power terminals respectively located at the second terminal position, third terminal position and eleventh terminal position. The tenth terminal position is empty.

In a forty-ninth embodiment shown in FIG. 12C, each row of terminals 20 have three additional power terminals respectively located at the second terminal position, tenth terminal position and eleventh terminal position. The third terminal position is empty.

In a fiftieth embodiment shown in FIG. 12D, each row of terminals 20 have three additional power terminals respectively located at the third terminal position, tenth terminal position and eleventh terminal position. The second terminal position is empty.

In FIG. 13, 'A', 'B', 'C' and 'D' designate perspective views showing the terminal arrangement in the fifty-first to the fifty-fourth embodiments. One additional power terminal and three additional grounding terminals are arranged at said vacant spaces in the fifty-first to the fifty-fourth embodiments.

In a fifty-first embodiment shown in FIG. 13A, each row of terminals 20 have one additional power terminal located at the second terminal position and three additional grounding terminals respectively located at the third terminal position, the tenth terminal position and the eleventh terminal position.

In a fifty-second embodiment shown in FIG. 13B, each row of terminals 20 have one additional power terminal located at the third terminal position and three additional grounding terminals respectively located at the second terminal position, the tenth terminal position and the eleventh terminal position.

In a fifty-third embodiment shown in FIG. 13C, each row of terminals 20 have one additional power terminal located at the tenth terminal position and three additional grounding terminals respectively located at the second terminal position, the third terminal position and the eleventh terminal position.

In a fifty-fourth embodiment shown in FIG. 13D, each row of terminals 20 have one additional power terminal located at the eleventh terminal position and three additional grounding terminals respectively located at the second terminal position, the third terminal position and the tenth terminal position.

In FIG. 14, 'A', 'B', 'C', 'D', 'E' and 'F' designate perspective views showing the terminal arrangement in the fifty-fifth to the sixtieth embodiments. Two additional power terminals and two additional grounding terminals are arranged at said vacant spaces in the fifty-fifth to the sixtieth embodiments.

In a fifty-fifth embodiment shown in FIG. 14A, each row of terminals 20 have two additional power terminals respectively located at the second terminal position and the third terminal position, and two additional grounding terminals respectively located at the tenth terminal position and the eleventh terminal position.

In a fifty-sixth embodiment shown in FIG. 14B, each row of terminals 20 have two additional power terminals respectively located at the second terminal position and the tenth terminal position, and two additional grounding terminals respectively located at the third terminal position and the eleventh terminal position.

In a fifty-seventh embodiment shown in FIG. 14C, each row of terminals 20 have two additional power terminals respectively located at the second terminal position and the eleventh terminal position, and two additional grounding terminals respectively located at the third terminal position and the tenth terminal position.

In a fifty-seventh embodiment shown in FIG. 14C, each row of terminals 20 have two additional power terminals respectively located at the second terminal position and the eleventh terminal position, and two additional grounding terminals respectively located at the third terminal position and the tenth terminal position.

In a fifty-eighth embodiment shown in FIG. 14D, each row of terminals 20 have two additional power terminals respectively located at the third terminal position and the tenth terminal position, and two additional grounding terminals respectively located at the second terminal position and the eleventh terminal position.

In a fifty-ninth embodiment shown in FIG. 14E, each row of terminals 20 have two additional power terminals respectively located at the third terminal position and the eleventh terminal position, and two additional grounding terminals respectively located at the second terminal position and the tenth terminal position.

In a sixtieth embodiment shown in FIG. 14F, each row of terminals 20 have two additional power terminals respectively located at the tenth terminal position and the eleventh terminal position, and two additional grounding terminals respectively located at the second terminal position and the third terminal position.

In FIG. 15, 'A', 'B', 'C' and 'D' designate perspective views showing the terminal arrangement in the sixty-first to the sixty-fourth embodiments. Three additional power terminals and one additional grounding terminal are arranged at said vacant spaces in the sixty-first to the sixty-fourth embodiments.

In a sixty-first embodiment shown in FIG. 15A, each row of terminals 20 have three additional power terminals respectively located at the second terminal position, the third terminal position and the tenth terminal position, and one additional grounding terminal located at the eleventh terminal position.

In a sixty-second embodiment shown in FIG. 15B, each row of terminals 20 have three additional power terminals respectively located at the second terminal position, the third terminal position and the eleventh terminal position, and one additional grounding terminal located at the tenth terminal position.

In a sixty-third embodiment shown in FIG. 15C, each row of terminals 20 have three additional power terminals respectively located at the second terminal position, the tenth terminal position and the eleventh terminal position, and one additional grounding terminal located at the third terminal position.

In a sixty-fourth embodiment shown in FIG. 15D, each row of terminals 20 have three additional power terminals respectively located at the third terminal position, the tenth terminal position and the eleventh terminal position, and one additional grounding terminal located at the second terminal position.

In FIG. 16, 'A' designates a perspective view showing the terminal arrangement in the sixty-fifth embodiment. each row of terminals 20 have four additional power terminals respectively located at the second terminal position, the third terminal position, the tenth terminal position and the eleventh terminal position in the vacant spaces.

Each row of terminals 20 have nine terminals 20 in the first to the fourth embodiments. Each row of terminals 20 have ten terminals 20 in the fifth to the sixteenth embodiments and the twenty-ninth to the thirty-fourth embodiments. Each row of terminals 20 have eleven terminals 20 in the seventeenth to the twenty-eighth embodiments and the thirty-fifth to the fiftieth embodiments. Each row of terminals 20 have twelve terminals 20 in the fifty-first to the sixty-fifth embodiments.

The additional power terminals and the additional ground terminals arranged at said vacant spaces are the power terminals and the ground terminals for distinguishing. It should be noted that in the invention the aforementioned sixty-five embodiments are not randomly formed and picked but derived from a formula of permutation/combination as described below.

As noted that because the terminals 20 are reversely symmetrically arranged in two rows, it is only required to pay attention to the vacant spaces on only one side of the tongue portion 11. In other words, only the spaces A2, A3, B11 and B10 on the left side are required to be analyzed for arrangement because the spaces B2, B3, A11 and A10 will be reversely symmetrically changed corresponding to the spaces A2, A3, B11 and B10, respectively. Understandably, each space may have three different choices, i.e., with power, grounding or vacancy. Therefore, the total combination number will be 3*3*3*3 and equals to 81. In this 81 combinations it is required to have at least one additional power contact for delivering the higher power, by deducting the combination number belonging to no additional power contact arrangement, only 65 combinations remain. It means there are 16 combinations having no additional power contact. This results from the formula as follows:

$$\Sigma_1{}^4C_{p=0}=C_p(4,0)*C_g(4,0)+C_p(4,0)*C_g(4,1)+C_p(4,0)*C_g(4,2)+C_p(4,0)*C_g(4,3)+C_p(4,0)*C_g(4,4)$$ wherein $\Sigma_1{}^4C_{p=0}$ represents the total combinations with no power contact in such four spaces;

$C_p$ (4,0) represents the combination factor under the situation that no one power contact in such four spaces;

$C_g$ (4,0) represents the combination factor under the situation that no one grounding contact in such four spaces;

$C_g$ (4,1) represents the combination factor under the situation that there is one grounding contact in such four spaces;

$C_g$ (4,2) represents the combination factor under the situation that there are two grounding contacts in such four spaces;

$C_g$ (4,3) represents the combination factor under the situation that there are three grounding contacts in such four spaces; and $C_g$ (4,4) represents the combination factor under the situation that there are four grounding contacts in such four spaces.

Therefore, $$\Sigma_1{}^4C_{p=0}=1*1+1*4+1*6+1*4+1*1=16$$

As mentioned above, because the total (possible) combination number is 81, the remaining combination number reflecting at least one power contact situations, should be 65, i.e., 81−16. The general formula is as follows:

$$\Sigma_1^n C_{p\geq 1} 3^n - \Sigma_1^n C_{p=0} = 3^4 - \Sigma_1^4 C_{p=0} = 81-16=65 \text{ wherein}$$

$C_{p\geq 1}$ represents the combination number for at least one power in the n spaces.

Understandably, this combination number can be also obtained by the sum $$\Sigma C_{p\geq 1} = C_{p=1} + C_{p=2} + C_{p=3} + C_{p=4} \text{ wherein}$$

$C_{p=1}$ represents the total combinations with one power contact in such four spaces;

$C_{p=2}$ represents the total combinations with two power contacts in such four spaces;

$C_{p=3}$ represents the total combinations with three power contacts in such four spaces; and $C_{p=4}$ represents the total combinations with four power contacts in such four spaces.

By following the same theory, $$\Sigma C_{p=1} = C_p(4,1)*C_g(3,0) + C_p(4,1)*C_g(3,1) + C_p(4,1)*C_g(3,2) + C_p(4,1)*C_g(3,3) \text{ wherein}$$

$C_p$ (4,1) represents the combination factor under the situation that there is one power contact in such four spaces;

$C_g$ (3,0) represents the combination factor under the situation that there is no grounding contact in the remaining three spaces;

$C_g$ (3,1) represents the combination factor under the situation that there is one grounding contact in the remaining three spaces;

$C_g$ (3,2) represents the combination factor under the situation there are two grounding contacts in the remaining three spaces; and $C_g$ (3,3) represents the combination factor under the situation there are three grounding contacts in the remaining three spaces.

Therefore, $$\Sigma C_{p=1} = C_p(4,1)*C_g(3,0) + C_p(4,1)*C_g(3,1) + C_p(4,1)*C_g(3,2) + C_p(4,1)*C_g(3,3) = 4*1+4*3+4*3=4*1=32$$

By following the same theory, $$\Sigma C_{p=2} = C_p(4,2)*C_g(2,0) + C_p(4,2)*C_g(2,1) + C_p(4,2)*C_g(2,2) \text{ wherein}$$

$C_p$ (4,2) represents the combination factor under the situation that there are two power contacts in such four spaces;

$C_g$ (2,0) represents the combination factor under the situation that there is no grounding contact in the remaining two spaces;

$C_g$ (2,1) represents the combination factor under the situation that there is one grounding contact in the remaining two spaces;

$C_g$ (2,2) represents the combination factor under the situation that there are two grounding contacts in the remaining two spaces;

Therefore, $$\Sigma C_{p=2} = C_p(4,2)*C_g(2,0) + C_p(4,2)*C_g(2,1) + C_p(4,2)*C_g(2,2) = 6*1+6*2+6*1=24$$

By following the same theory, $$\Sigma C_{p=3} = C_p(4,3)*C_g(1,0) + C_p(4,3)*C_g(1,1) \text{ wherein}$$

$C_p$ (4,3) represents the combination factor under the situation that there are three power contacts in such four spaces;

$C_g$ (1,0) represents the combination factor under the situation that there is no grounding contact in the remaining one space;

$C_g$ (1,1) represents the combination factor under the situation that there is one grounding contact in the remaining one space;

Therefore, $$\Sigma C_{p=3} = C_p(4,3)*C_g(1,0) + C_p(4,3)*C_g(1,1) = 4*1+4*1=8$$

By following the same theory lastly, $$\Sigma C_{p=4} = C_p(4,4)*C_g(0,0) = 1$$

$C_p$ (4,4) represents the combination factor under the situation that there are four power contacts in such four spaces; and $C_g$ (0,0) represents the combination factor under the situation that there is no grounding contact in remaining no space.

Therefore, the sum $\Sigma C_{p\geq 1}$ of $C_{p=1}+C_{p=2}+C_{p=3}+C_{p=4}$ is also 65, i.e., 32+24+8+1.

The latter calculation way has the same result, i.e., the combination number 65, with the previous one.

Therefore, according to this calculation way, it is easy to obtain the combination number for the six, rather than four, vacant spaces with at least one additional power contact by the same formula:

$$\begin{aligned}\Sigma C_{p=0} &= C_p(6,0)*C_g(6,0) + C_p(6,0)*C_g(6,1) + C_p(6,0)*C_g(6,2) + C_p(6,0)*C_g(6,3) + C_p(6,0)*C_g(6,4) + C_p(6,0)*C_g(6,5) + C_p(6,0)*C_g(6,6)\\ &= 1*1+1*6+1*15+1*20+1*15+1*6+1*1\\ &= 1+6+15+20+15+6+1\\ &= 64\end{aligned}$$

Because the total combination 3*3*3*3*3*3 is equal to 729. the remaining combination number, which reflects at least one additional power contact, is 665.

Therefore, the general formula for calculating the combination number of the n spaces with least one power contact is as follow:

$$\Sigma_1^n C_{p\geq 1} = 3_n - \Sigma_1^n C_{p=0} = 3^n - (C_g(n,0) + C_g(n,1) + C_g(n,2) + \ldots + C_g(n,n-1) + C_g(n,n)) \text{ wherein}$$

$\Sigma_1^n C_{p\geq 1}$ represents the total combination number for the n spaces with at least one power contact therein;

$3^n$ represents the total combination number for the n spaces among the power contact, the grounding contact and the vacancy;

$\Sigma_1^n C_{p=0}$ represents the total combination number for n spaces without any power contact in any of the spaces; and $C_g$ (n,0) represents the combination factor under the situation that there is no grounding contacts in the n spaces, $C_g$ (n,1) represents the combination factor under the situation that there is one grounding contacts in the n spaces, $C_g$ (n,2) represents the combination factor under the situation that there are two grounding contacts in the n spaces, . . . $C_g$ (n,n−1) represents the combination factor under the situation that there are n−1 grounding contacts in the n spaces, and $C_g$ (n,n) represents the combination factor under the situation that there are n grounding contacts in the n spaces.

Notably, with the aforementioned formula the arrangement of the vacant spaces for the additional power contacts may be systematically controllable, thus assuring the whole connector may be reliably designed.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a tongue portion, the tongue portion defining two opposite surfaces, each surface of the tongue portion including twelve terminal positions; and two rows of terminals being reversely-symmetrically arranged at the two surfaces of the tongue portion, each terminal having a contact portion exposed on the tongue portion, each row of terminals comprising two grounding terminals respectively arranged at the first and the twelfth terminal positions of the twelve terminal positions, and two power terminals respectively arranged at the fourth and the ninth terminal positions of the twelve terminal positions, the second, third, tenth and eleventh terminal positions of the twelve terminal positions being defined as vacant spaces, one or more further power terminals being arranged at said vacant spaces.

2. The electrical connector as claimed in claim 1, wherein said vacant spaces only have one power terminal.

3. The electrical connector as claimed in claim 1, wherein said vacant spaces only have one power terminal and one grounding terminal.

4. The electrical connector as claimed in claim 1, wherein said vacant spaces only have one power terminal and two grounding terminals.

5. The electrical connector as claimed in claim 1, wherein said vacant spaces only have two power terminals.

6. The electrical connector as claimed in claim 1, wherein said vacant spaces only have two power terminals and one grounding terminal.

7. The electrical connector as claimed in claim 1, wherein said vacant spaces only have three power terminals.

8. The electrical connector as claimed in claim 1, wherein said vacant spaces have one power terminal and three grounding terminals.

9. The electrical connector as claimed in claim 1, wherein said vacant spaces have two power terminals and two grounding terminals.

10. The electrical connector as claimed in claim 1, wherein said vacant spaces have three power terminals and one grounding terminal.

11. The electrical connector as claimed in claim 1, wherein said vacant spaces have four power terminals.

12. The electrical connector comprising:

an insulative housing including two rows of spaces to receive corresponding two rows of terminals along a transverse direction, wherein said two rows of terminals are arranged in a diagonally symmetrical manner with each other;

a pair of grounding contacts located at two opposite ends of each of said two rows;

a pair of power contacts located between said pair of grounding contacts in said transverse direction in each row;

a plurality of vacant spaces located between the pair of power contacts and the pair of grounding contacts in the transverse direction in two rows; wherein in said two rows of spaces, there are n vacant spaces between the power contacts and the grounding contacts on each side with regard to a center line of the housing, each vacant space is adapted to receive a power contact, a grounding contact or be vacant in combination, and at least one power contacts is received in one of said n spaces; wherein a total combination number for said n spaces with at least one power contact is regulated by a formula as follows:

$$\Sigma_1^n C_{p\geq 1}=3^n-\Sigma_1^n C_{p=0}=3^n-(C_g(n,0)+C_g(n,1)+C_g(n,2)+\ldots+C_g(n,n-1)+C_g(n,n))$$ wherein $\Sigma_1^n C_{p\geq 1}$ represents the total combination number for the n spaces with at least one power contact in said n spaces;

$3^n$ represents the total combination number for the n spaces among the power contact, the grounding contact and the vacancy;

$\Sigma_1^n C_{p=0}$ represents the total combination number for n spaces without any power contact in any of the n spaces; and $C_g$ (n,0) represents the combination factor under the situation that there is no grounding contacts in the n spaces, $C_g$ (n,1) represents the combination factor under the situation that there is one grounding contacts in the n spaces, $C_g$ (n,2) represents the combination factor under the situation that there are two grounding contacts in the n spaces, . . . , $C_g$ (n,n−1) represents the combination factor under the situation that there are n−1 grounding contacts in the n spaces, and $C_g$ (n,n) represents the combination factor under the situation that there are n grounding contacts in the n spaces.

13. The electrical connector as claimed in claim 12, wherein said two rows of spaces and the corresponding two rows of terminals are located upon two opposite surfaces of a tongue portion of the housing.

14. The electrical connector as claimed in claim 12, wherein the spaces are formed with a constant pitch.

15. The electrical connector as claimed in claim 12, wherein the power contacts and the grounding contacts are dimensioned same with each other.

16. The electrical connector as claimed in claim 12, wherein no additional power contact is disposed between each corresponding pair of power contacts.

17. The electrical connector as claimed in claim 12, wherein there are twelve spaces in each row and the pair of grounding contacts are located at a first space and a twelfth space while the pair of power contacts are located at a fourth space and the ninth space, so an amount of the vacant spaces between the pair of power contacts and the pair of grounding contacts is four on each side of the housing with regard to the center line of the housing.

18. The electrical connector as claimed in claim 17, wherein $\Sigma_1^n C_{p\geq 1}$, which is the total combination number for said n spaces with at least one power contact therein, is 65 by following the formula.

* * * * *